US008217322B2

(12) United States Patent
Houston et al.

(10) Patent No.: US 8,217,322 B2
(45) Date of Patent: Jul. 10, 2012

(54) TEMPERATURE RESPONSIVE BACK BIAS CONTROL FOR INTEGRATED CIRCUIT

(75) Inventors: Theodore W. Houston, Richardson, TX (US); Andrew Marshall, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 12/916,231

(22) Filed: Oct. 29, 2010

(65) Prior Publication Data

US 2011/0043255 A1 Feb. 24, 2011

Related U.S. Application Data

(62) Division of application No. 11/234,910, filed on Sep. 26, 2005, now abandoned.

(51) Int. Cl.
*H05B 1/02* (2006.01)

(52) U.S. Cl. ..... 219/494; 219/497; 219/501; 438/17; 324/750.03

(58) Field of Classification Search ..... 219/494, 219/497, 501; 234/750, 754, 755, 759, 760; 438/17; 324/750.03, 754, 755, 759, 760
See application file for complete search history.

(56) References Cited

U.S. PATENT DOCUMENTS

| | | | |
|---|---|---|---|
| 6,702,457 | B1 | 3/2004 | Smith |
| 6,965,264 | B1 | 11/2005 | Chan et al. |
| 2002/0158652 | A1 | 10/2002 | Okayasu |
| 2005/0104566 | A1 | 5/2005 | Kim |

*Primary Examiner* — Mark Paschall
(74) *Attorney, Agent, or Firm* — John J. Patti; Wade J. Brady, III; Frederick J. Telecky, Jr.

(57) ABSTRACT

The present invention provides a thermostatic biasing controller for use with an integrated circuit. In one embodiment, the thermostatic biasing controller includes a temperature sensing unit configured to determine an operating temperature of the integrated circuit. Additionally, the thermostatic biasing controller also includes a voltage controlling unit coupled to the temperature sensing unit and configured to provide a back-bias voltage corresponding to the operating temperature based on reducing a quiescent current of the integrated circuit.

21 Claims, 3 Drawing Sheets

TEMPERATURE RESPONSIVE BACK BIAS CONTROL FOR INTEGRATED CIRCUIT

CROSS-REFERENCE TO RELATED APPLICATIONS

This application is a divisional of U.S. patent application Ser. No. 11/234,910, filed on Sep. 26, 2005, which is hereby incorporated by reference for all purposes.

TECHNICAL FIELD

The present invention is directed, in general, to microelectronics and, more specifically, to a thermostatic biasing controller, a method of thermostatic biasing and an integrated circuit employing the controller or the method.

BACKGROUND

Reverse back bias, that is, increasing the reverse bias between an integrated circuit body and the sources of transistors employed in the integrated circuit, has been a tool for reducing quiescent currents such as the direct drain quiescent current IDDQ. A reverse back bias increases the threshold voltage Vt, thus reducing subthreshold currents for the integrated circuit transistors. However, reverse back bias also increases the diode leakage between the integrated circuit body and the transistors. So, there is a trade-off between reducing subthreshold current and increasing diode leakage.

The number of integrated circuit devices associated with an integrated circuit chip continues to increase while device size continues to scale downward thereby providing an increase in device density. These scaled technologies employ higher doping levels causing proportionally higher diode leakage. This increasing diode leakage thereby reduces the effectiveness of applying back bias to reduce IDDQ. In fact, for some applications, applying back bias increases IDDQ at room temperature.

Accordingly, what is needed in the art is a more effective way to compensate for these leakage effects, especially over a variety of operating temperature.

SUMMARY

To address the above-discussed deficiencies of the prior art, the present invention provides a thermostatic biasing controller for use with an integrated circuit. In one embodiment, the thermostatic biasing controller includes a temperature sensing unit configured to determine an operating temperature of the integrated circuit. Additionally, the thermostatic biasing controller also includes a voltage controlling unit coupled to the temperature sensing unit and configured to provide a back-bias voltage corresponding to the operating temperature based on reducing a quiescent current of the integrated circuit.

In another aspect, the present invention provides a method of thermostatic biasing for use with an integrated circuit. The method includes determining an operating temperature of the integrated circuit and providing a back-bias voltage corresponding to the operating temperature based on reducing a quiescent current of the integrated circuit. Additionally, the present invention also provides an alternative method of controlling a current for use with circuitry having a body region and employing a plurality of voltage outputs that vary with temperature. The alternative method includes generating a temperature-dependent hysteretic voltage by comparing the plurality of voltage outputs to a substantially invariant reference voltage and stabilizing the current with temperature by employing the temperature-dependent hysteretic voltage in body-biasing the body region.

The present invention also provides, in yet another aspect, an integrated circuit that includes a supply voltage, an integrated subcircuit coupled to the supply voltage that has a body node connection and a thermostatic biasing controller coupled to the body node connection. The thermostatic biasing controller includes a temperature sensing unit that determines an operating temperature of the integrated circuit. The thermostatic biasing controller also includes a voltage controlling unit, coupled to the temperature sensing unit, that provides a back-bias voltage corresponding to the operating temperature for reducing a quiescent current of the integrated circuit.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
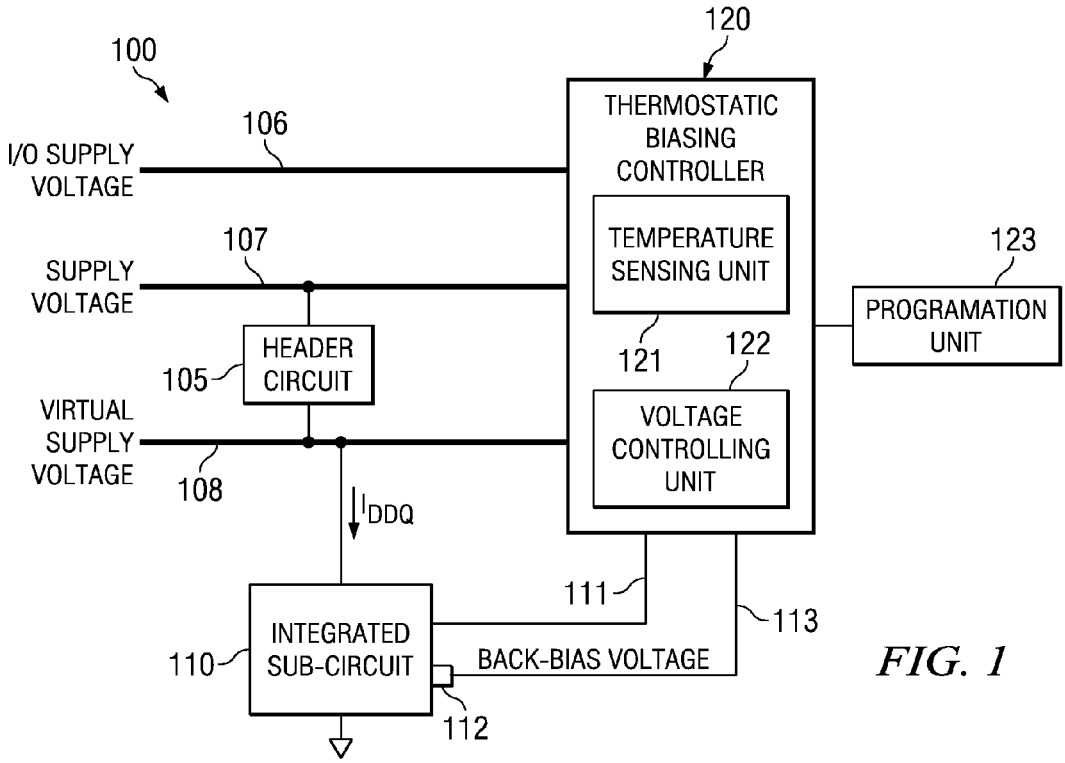
FIG. 1 illustrates a diagram of an embodiment of an integrated circuit constructed in accordance with the principles of the present invention.

Referring initially to FIG. 1, illustrated is a diagram of an embodiment of an integrated circuit, generally designated 100, constructed in accordance with the principles of the present invention. The integrated circuit 100 includes a header circuit 105, an integrated subcircuit 110 and a thermostatic biasing controller 120. The integrated circuit 100 also includes an input/output supply voltage 106 and a supply voltage 107 coupled to the header circuit 105, which is employed to provide a virtual supply voltage 108 to the integrated subcircuit 110. In the illustrated embodiment, the integrated subcircuit 110 provides a temperature sensing connection 111 and a body node connection 112 from the integrated subcircuit 110 to the thermostatic biasing controller 120.

The thermostatic biasing controller 120 includes a temperature sensing unit 121 coupled to the temperature sensing connection 111 and a voltage control unit 122 coupled to the body node connection 112. In alternative embodiments, the thermostatic biasing controller 120 may be separate from the integrated circuit 100 or the integrated subcircuit 110 while employing these connections. Additionally, the temperature sensing and body node connections 111, 112 may be integral with the thermostatic biasing controller 120, in yet other embodiments.

The temperature sensing unit 121 determines an operating temperature of the integrated subcircuit 110, and the voltage controlling unit 122, which is coupled to the temperature sensing unit 121, provides a back-bias voltage 113 corresponding to the operating temperature for reducing the quiescent current IDDQ of the integrated subcircuit 110. Of course, other embodiments may focus on reducing other quiescent currents as appropriate to a particular application.

In the illustrated embodiment, the integrated subcircuit 110 is an SRAM having active and data-retention modes. In alternate embodiments, the integrated subcircuit 110 may be a DSP or any of an assortment of general logic wherein the logic timing has been designed to function properly while employing a changing back-bias voltage. As noted earlier, applying a back-bias voltage may increase the quiescent current IDDQ at room temperature. However, at a higher temperature (which is generally worst case for the quiescent current IDDQ) the back-bias voltage will reduce the quiescent current IDDQ. This temperature dependence results from the stronger temperature dependence of subthreshold leakage versus the temperature dependence of diode leakage. Therefore, the thermostatic biasing controller 120 provides a temperature dependent back-bias voltage.

In the illustrated embodiment, the integrated subcircuit 110 employs a temperature sensor that is located integral or ("on-chip") with the integrated circuit 100. In an alternative embodiment, a temperature sensor may be located proximate the integrated subcircuit 110. Either the on-chip or proximate temperature detector may be employed to control the connection of back-bias voltage, switching to reverse back bias for higher temperatures and to zero back bias (or even forward back bias) for lower temperatures. In addition, the temperatures of switching can be adjusted at test depending on the process corner. Also, a so-called "cold" or "weak" chip may not need to switch between modes until much higher temperatures. In some cases, switching may not be needed at all. This can be assessed at final test of the integrated subcircuit 110, and fuses or other non-volatile memory may be employed to trim the temperatures of back-bias voltage switching appropriately.

The temperature sensing unit 121 may determine the operating temperature on an intermittent basis. This normally corresponds to a low power operating mode of the integrated subcircuit 110. Additionally, the thermostatic biasing controller 120 may discontinue sampling the temperature of the integrated subcircuit 110 upon reaching a predetermined temperature. For a low power mode, the power required for temperature sensing may be significant since temperature sensors can dissipate a fair amount of power. For such a case, the temperature sensing circuitry may be turned on periodically rather than continually. Also, periodic sensing may be turned off, in the low power mode, once low temperature is detected. An example of such circuitry is discussed with respect to FIG. 4.

The voltage controlling unit 122 typically provides the back-bias voltage 113 that has a substantially constant value over a range of operating temperatures. Additionally, a plurality of back-bias voltages may be provided that correspond to a plurality of operating temperature ranges. In the illustrated embodiment, the back-bias voltage 113 may employ the input/output supply voltage 106, the supply voltage 107 or the virtual supply voltage 108. Alternatively, the back-bias voltage 113 provided by the voltage controlling unit 122 may vary continuously with temperature as appropriate to a particular application.

In the illustrated embodiment, the voltage controlling unit 122 provides the back-bias voltage 113 that exhibits a hysteresis as a function of temperature. The hysteresis allows a dynamic setting of the back-bias voltage 113 that prevents switching back and forth (i.e., dithering) between two values at a crossover point between two leakage currents or temperature regions. This characteristic is further illustrated and discussed with respect to FIGS. 3 and 4.

The thermostatic controller 120 may further employ a programation unit 123 having a fuse circuit to select the back-bias voltage 113. The fuse circuit provides a non-dynamic capability to select a reverse back-bias voltage. This allows the reverse back-bias voltage to be enabled for applications where high temperature is expected to dominate power concerns. Conversely, the reverse back-bias voltage may be disabled for applications where low temperature is expected to dominate power concerns. The fuse circuit may also be used to set the temperature-to-body relationship. For example, a fuse circuit may be used to set the temperature at which the body bias is switched from one value to another.

The fuse circuit is typically a one-time and non-dynamic option that is set at packaging, when knowing the application intended for the integrated subcircuit 110 or when knowing the transistor characteristics of the circuit. Additionally, the fuse circuit may be used in conjunction with or be replaced by a ROM setting associated with a ROM circuit, also included in the programation unit 123, and be field programmable.

Figure 2:
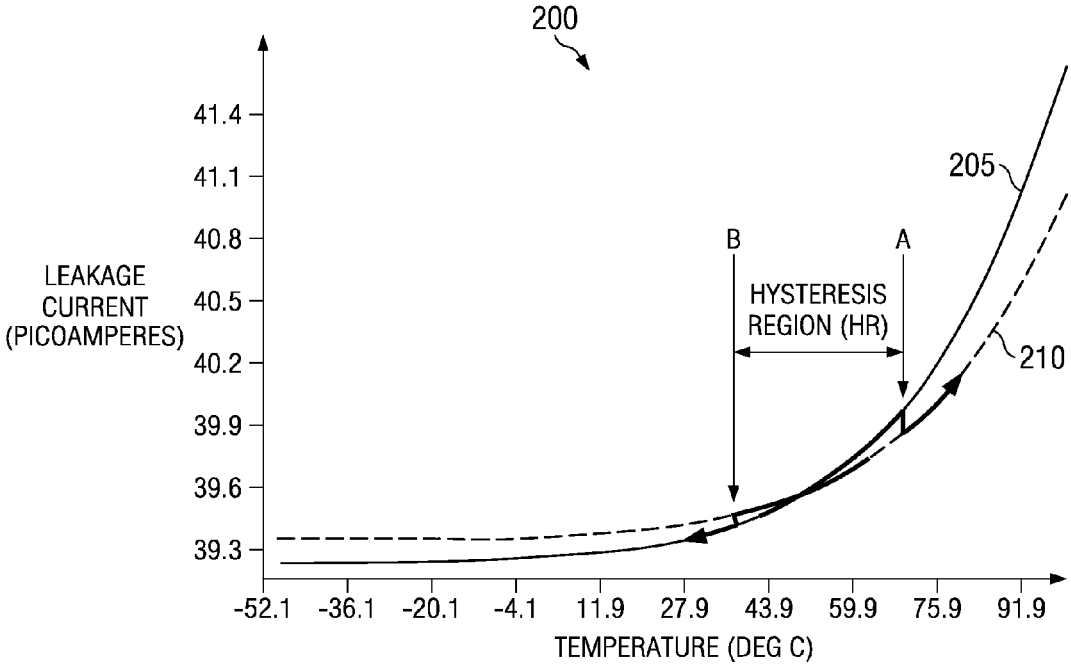
FIG. 2 illustrates a leakage graph showing an example of a leakage current hysteresis constructed in accordance with the principles of the present invention.

Turning now to FIG. 2, illustrated is a leakage graph showing an example of a leakage current hysteresis, generally designated 200, constructed in accordance with the principles of the present invention. The leakage graph 200 includes first and second leakage current curves 205, 210 and a hysteresis region HR, which occurs between a first hysteresis point A and a second hysteresis point B, as shown. The first hysteresis point A provides a shift from the first leakage current curve 205 to the second leakage current curve 210, which may be seen to provide lower values of leakage current with increasing temperatures. A corresponding effect occurs at the second hysteresis point B where a shift from the second leakage current curve 210 to the first leakage current curve 205, which may be seen to provide lower values of leakage current with decreasing temperatures. Employing the hysteresis region HR avoids a dithering between the first and second leakage current curves 205, 210 at their cross-over point, which may otherwise occur.

Figure 3:
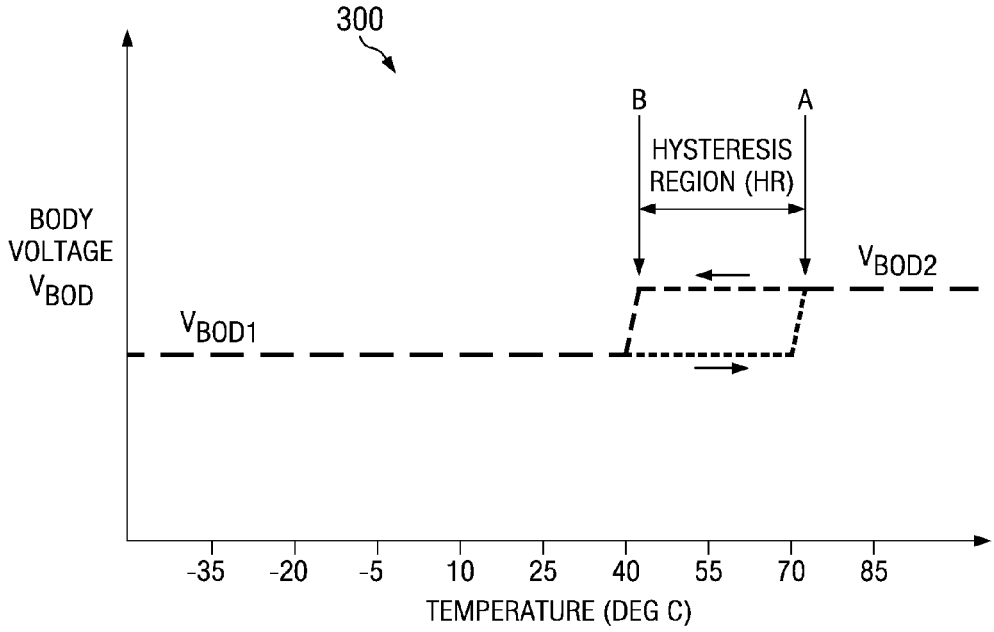
FIG. 3 illustrates a voltage graph showing an example of a body voltage hysteresis corresponding to the leakage current hysteresis of FIG. 2.

Turning now to FIG. 3, illustrated is a voltage graph showing an example of a body voltage hysteresis, generally designated 300, corresponding to the leakage current hysteresis of FIG. 2. The voltage graph 300 includes first and second body voltage levels VBOD1, VBOD2 and a hysteresis region HR, which occurs between a first hysteresis point A and a second hysteresis point B, as shown. The first and second body voltage levels VBOD1, VBOD2 indicate how a body node associated with an integrated circuit, such as that discussed with respect to FIG. 1, may be varied to modify the leakage current of the integrated circuit as was discussed with respect to FIG. 2.

Figure 4:
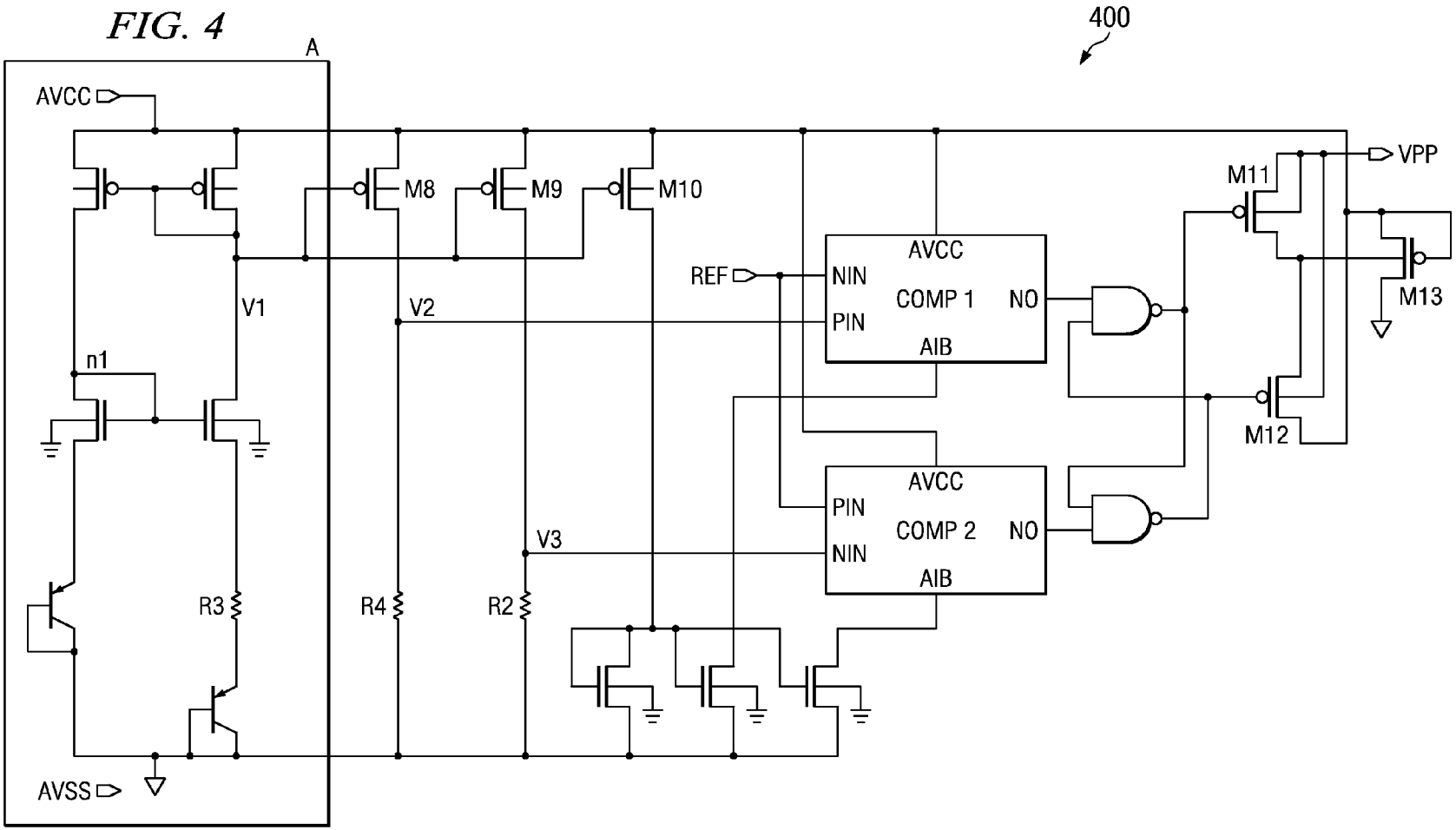
FIG. 4 illustrates a schematic diagram of an embodiment of a body-bias voltage circuit constructed in accordance with the principles of the present invention.

Turning now to FIG. 4, illustrated is a schematic diagram of an embodiment of a body-bias voltage circuit, generally designated 400, constructed in accordance with the principles of the present invention. The body-bias voltage circuit 400 is an exemplary schematic showing how the switching between body biases, including hysteresis, may be achieved. A dual temperature sensor is used to trigger the switch between modes. As temperature rises, this switch occurs at a higher temperature. As the temperature cools, switching back to the original state does not occur until the lower temperature is reached. This temperature level can also be used as part of an "OR" function to switch-off the temperature sensor (i.e., while the power or the temperature is high, the temperature sensor is ON). This may be modified for further power reduction by only enabling the temperature sensor periodically, either continually or just when the standby mode has been initiated.

Subcircuit A of FIG. 4 shows a conventional MOS-based Iptat. This generates a current which can be mirrored through M8, M9 and M10, to provide either a temperature dependent or temperature independent current that is largely independent of other factors, especially supply voltage. Resistors R4 and R2 are of the same material type as resistor R3, but are of different values, which negate the variability of the resistor type. The resulting voltages V2 and V3 are dependent on the Iptat current generator and values of resistors R2 and R4. They can be adjusted by modifying the Iptat components, the ratio of M8:M9:M10 and the values of resistors R2 and R4. These voltages define the trigger points of the body bias switches. Currents supplied to the AIB inputs of first and second comparator modules COMP1, COMP2 are herein generated by the Iptat, but alternatively, may also be generated by any other current source method. The reference can be generated by any convenient reference supply, or could readily be generated from the Iptat.

The voltages V2 and V3 rise and fall with temperature. As temperature rises and the threshold of the voltage V2 rises above a reference voltage Vref, the first comparator module COMP1 switches from LOW to HIGH, but does not affect the state of M11 and M12. When the voltage V3 becomes higher than the reference voltage Vref, at some higher temperature, the second comparator module COMP2 switches, forcing M12 gate LOW and M11 gate HIGH, thereby switching the body bias of M13 into the lower leakage "body bias to source" state. If the temperature decreases, nothing happens to the state of M11 and M12 until the voltage V2 is below the reference voltage Vref, wherein M11 turns ON and M12 turns OFF, changing the gate biasing. The hysteresis thus afforded prevents an indeterminate state around the body switching point.

Figure 5:
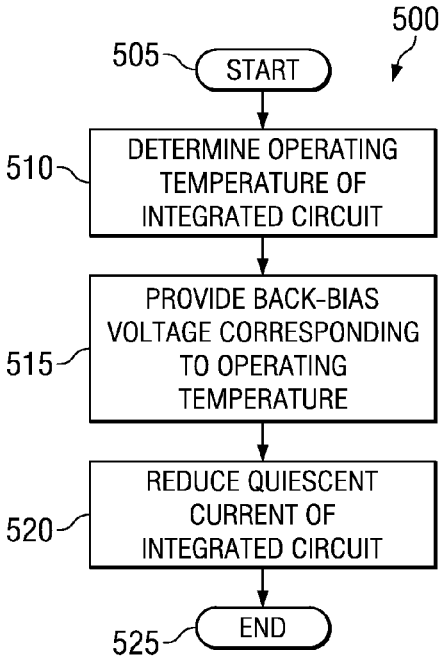
FIG. 5 illustrates a flow diagram of a method of thermostatic biasing carried out in accordance with the principles of the present invention.

Turning now to FIG. 5, illustrated is a flow diagram of an embodiment of a method of thermostatic biasing, generally designated 500, carried out in accordance with the principles of the present invention. The method 500 is for use with and an integrated circuit and starts in a step 505. Then, in a step 510, an operating temperature of the integrated circuit is determined. Determination of the operating temperature may employ a temperature sensor located proximate the integrated circuit or a temperature sensor that is integral with the integrated circuit.

Additionally, the operating temperature may be determined on a continuous basis or it may be determined on an intermittent basis wherein it is sampled either periodically or randomly over time. Since temperature sampling requires a power expenditure, a low-power operating mode of the integrated circuit may typically employ an intermittent sampling of the operating temperature. Also, this intermittent sampling may also be discontinued when the integrated circuit has reached a predetermined temperature or crossed a temperature threshold thereby allowing additional power conservation.

A back-bias voltage corresponding to the operating temperature is provided in a step 515. The back-bias voltage is applied to a body node of the integrated circuit. A same back-bias voltage may be employed over a range of operating temperatures. This would also allow the back-bias voltage to be supplied as a difference between two voltages for a band of operating temperatures. The back-bias voltage may employ a supply voltage or a virtual supply voltage derived from the supply voltage. Also, the back-bias voltage may employ an input/output supply voltage, as well.

Additionally, a plurality of back-bias voltages may be employed corresponding to a plurality of operating temperature ranges or bands. This plurality of back-bias voltages may be structured in values to provide a tailored leakage or quiescent current response for the integrated circuit.

The back-bias voltage may be programmable in either discrete steps or in a continuous manner. In order to avoid a dithering of the back-bias voltage between two values at a control cross-over point, hysteresis as a function of temperature may be employed. Additionally, if the operating temperature of the integrated circuit is set or determined to be a particular value, a fuse circuit or a ROM (read-only memory) circuit may select an appropriate back-bias voltage.

Then, in a step 520, a quiescent current of the integrated circuit is reduced employing the back-bias voltage provided in the step 515. The quiescent current is typically a direct drain quiescent current (IDDQ) associated with the integrated circuit. However, the principles of the present invention may be employed to reduce other leakage or quiescent currents of the integrated circuit as may be appropriate to a particular application. The method 500 ends in a step 525.

Figure 6:
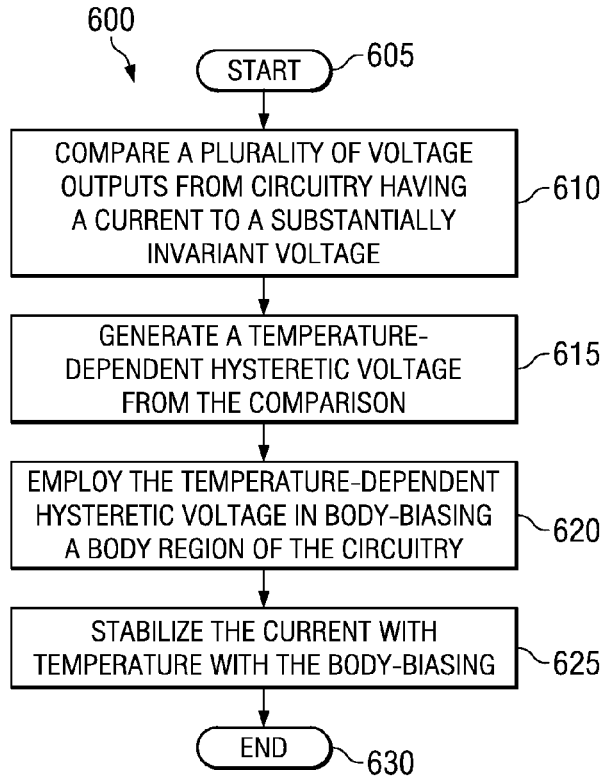
FIG. 6 illustrates a flow diagram of an embodiment of a method of controlling a current carried out in accordance with the principles of the present invention.

Turning now to FIG. 6, illustrated is a flow diagram of an embodiment of a method of controlling a current, generally designated 600, carried out in accordance with the principles of the present invention. The method 600 is used with circuitry having a body region, employing a plurality of voltage outputs that varies with temperature and starts in a step 605.

Then in a step 610, the plurality of voltage outputs is compared to a substantially invariant voltage, and a temperature-dependent hysteretic voltage is generated from the comparison in a step 615. The temperature-dependent hysteretic voltage is employed in body-biasing a body region of the circuitry in a step 620. Application of the temperature-dependent hysteretic voltage in the step 620 provides body-biasing that results in stabilizing the current with respect to temperature for the circuitry. The method ends in a step 625.

While the methods disclosed herein have been described and shown with reference to particular steps performed in a particular order, it will be understood that these steps may be combined, subdivided, or reordered to form equivalent methods without departing from the teachings of the present invention. Accordingly, unless specifically indicated herein, the order or the grouping of the steps is not a limitation of the present invention.

In summary, embodiments of the present invention employing a thermostatic biasing controller, a method of thermostatic biasing and an integrated circuit employing the controller or the method have been presented. An additional embodiment of a method of controlling a current associated with circuitry has also been presented. Advantages include the ability to select or adapt a back-bias voltage as a function of operating temperature that will reduce a quiescent current for an integrated circuit as appropriate to a particular application. The additional method of controlling the current provides a temperature-dependent hysteretic voltage that is employed in body-biasing a body region of the circuitry thereby providing stabilization of the current with temperature. Embodiments of the present invention allow reductions in operating power for integrated circuits, which is becoming an attribute of primary concern.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

The invention claimed is:

1. An apparatus comprising:

a temperature sensing circuit that generates first and second temperature-dependant voltages;

a comparison circuit that is coupled to the temperature sensing circuit so as to receive the first and second temperature-dependant voltages, that receives a reference voltage, and that generates first and second control signals; and a body-bias switching circuit that is coupled to the comparison circuit so as to receive the first and second control signals, wherein the body-bias switching circuit generates a back-bias voltage for at least one of a high leakage state and a low leakage state based at least in part on the first and second control signals.

2. The apparatus of claim 1, wherein the body-biasing switching circuit further comprises:

a first MOS transistor that is coupled to the comparison circuit at its gate so as to receive the first control signal;

a second MOS transistor that is coupled to the comparison circuit at its gate so as to receive the second control signal; and an output node that is coupled between the first and second MOS transistors so as to provide the back-bias voltage.

3. The apparatus of claim 2, wherein the first and second transistors further comprise first and second PMOS transistors.

4. The apparatus of claim 2, wherein the comparison circuit further comprises:

a first comparator having a first input terminal, a second input terminal, and an output terminal, wherein the first input terminal of the first comparator receives the reference voltage, and wherein the second input terminal of the first comparator is coupled to the temperature sensing circuit so as to receive the first temperature-dependant voltage;

a second comparator having a first input terminal, a second input terminal, and an output terminal, wherein the first input terminal of the second comparator receives the reference voltage, and wherein the second input terminal of the second comparator is coupled to the temperature sensing circuit so as to receive the second temperature-dependant voltage; and a logic circuit that is coupled to the output terminals of the first and second comparators and the gates of the first and second PMOS transistors, wherein the logic circuit generates the first and second control signals.

5. The apparatus of claim 4, wherein the logic circuit further comprises:

a first NAND gate that is coupled to the output terminal of the first comparator and the gates of the first and second PMOS transistors; and a second NAND gate that is coupled to the second comparator and the gates of the first and second PMOS transistors.

6. The apparatus of claim 5, wherein the temperature sensing circuit further comprises:

a current generator that generates a current that is proportional to absolute temperature (PTAT); and a voltage generator is coupled to the current generator so as to receive the PTAT current and that generates the first and second temperature-dependant voltages based at least in part on the PTAT current.

7. The apparatus of claim 6, wherein the voltage generator further comprises:

a third PMOS transistor that is coupled to the second input terminal of the first comparator at its drain and that is coupled to the current generator at its gate;

a fourth PMOS transistor that is coupled to the second input terminal of the second comparator at its drain and that is coupled to the current generator at its gate;

a first resistor that is coupled to the drain of the third PMOS transistor; and a second resistor that is coupled to the drain of the fourth PMOS transistor.

8. The apparatus of claim 1, wherein the temperature sensing circuit operates intermittently.

9. The apparatus of claim 8, wherein the temperature sensing circuit operates randomly over time.

10. A method comprising:

generating first and second temperature-dependant voltages, wherein the first and second temperature-dependant voltages increase with a rise in temperature and decrease with a fall in the temperature;

switching a body-bias voltage for a low leakage state when the second temperature-dependant voltage becomes greater than a reference voltage; and switching the body-bias voltage from the low leakage state to a high leakage state when the first temperature-dependant voltage becomes less than the reference voltage.

11. The method of claim 10, wherein the step of switching the body-bias voltage for the low leakage state further comprises:

generating a first comparison result reflecting that the first temperature-dependant voltage is greater than the reference voltage when the first temperature-dependant voltage becomes greater than the reference voltage;

generating a second comparison result reflecting that the second temperature-dependant voltage is greater than the reference voltage when the second temperature-dependant voltage becomes greater than the reference voltage;

logically combining the first and second comparison results; and switching the body-bias voltage from the high leakage state to the low leakage state based on the logical combination of the first and second comparison results.

12. The method of claim 11, wherein the step of switching the body-bias voltage from the low leakage state to the high leakage state when the first temperature-dependant becomes less than the reference voltage further comprises:

generating a third comparison result reflecting that the second temperature-dependant voltage is less than the reference voltage when the second temperature-dependant voltage becomes less than the reference voltage;

generating a fourth comparison result reflecting that the first temperature-dependant voltage is less than the reference voltage when the first temperature-dependant voltage becomes less than the reference voltage;

logically combining the third and fourth comparison results; and switching the body-bias voltage from the low leakage state to the high leakage state based on the logical combination of the first and second comparison results.

13. The method of claim 12, wherein the step of generating further comprises:

generating a PTAT current; and generating first and second temperature-dependant voltages based at least in part in the PTAT current.

14. The method of claim 13, wherein the step of generating first and second temperature-dependant voltages occurs intermittently.

15. The method of claim 13, wherein the step of generating first and second temperature-dependant voltages occurs randomly over time.

16. An apparatus comprising:

means for generating first and second temperature-dependant voltages, wherein the first and second temperature-dependant voltages increase with a rise in temperature and decrease with a fall in the temperature;

means for switching a body-bias voltage for a low leakage state when the second temperature-dependant voltage becomes greater than a reference voltage; and means for switching the body-bias voltage from the low leakage state to a high leakage state when the first temperature-dependant voltage becomes less than the reference voltage.

17. The apparatus of claim 16, wherein the means for switching the body-bias voltage for the low leakage state further comprises:

means for generating a first comparison result reflecting that the first temperature-dependant voltage is greater than the reference voltage when the first temperature-dependant voltage becomes greater than the reference voltage;

means for generating a second comparison result reflecting that the second temperature-dependant voltage is greater than the reference voltage when the second temperature-dependant voltage becomes greater than the reference voltage;

means for logically combining the first and second comparison results; and means for switching the body-bias voltage from the high leakage state to the low leakage state based on the logical combination of the first and second comparison results.

18. The apparatus of claim 17, wherein the means for switching the body-bias voltage from the low leakage state to the high leakage state when the first temperature-dependant voltage becomes less than the reference voltage further comprises:

means for generating a third comparison result reflecting that the second temperature-dependant voltage is less than the reference voltage when the second temperature-dependant voltage becomes less than the reference voltage;

means for generating a fourth comparison result reflecting that the first temperature-dependant voltage is less than the reference voltage when the first temperature-dependant voltage becomes less than the reference voltage;

means for logically combining the third and fourth comparison results; and means for switching the body-bias voltage from the low leakage state to the high leakage state based on the logical combination of the first and second comparison results.

19. The apparatus of claim 18, wherein the means for generating further comprises:

means for generating a PTAT current; and means for generating first and second temperature-dependant voltages based at least in part in the PTAT current.

20. The apparatus of claim 19, wherein the means for generating first and second temperature-dependant voltages operates intermittently.

21. The apparatus of claim 19, wherein the means for generating first and second temperature-dependant voltages operates randomly over time.

* * * * *